US005524841A

United States Patent [19]

Rijk et al.

[11] Patent Number: 5,524,841

[45] Date of Patent: Jun. 11, 1996

[54] APPARATUS AND METHODS FOR WINDING A PLURALITY OF STRANDS

[75] Inventors: Magdalena J. M. Rijk, Hoogezand; Albert J. Messchendorp, Zuidlaren; Harm Haan, Niekerk, all of Netherlands

[73] Assignee: PPG Industries, Inc., Pittsburgh, Pa.

[21] Appl. No.: 249,314

[22] Filed: May 26, 1994

[51] Int. Cl.[6] ..... B65H 54/00; B65H 54/28; B65H 57/00

[52] U.S. Cl. ..... 242/42; 242/18.00 G; 242/157.100; 242/43 R

[58] Field of Search ..... 242/42, 18 G, 242/157.1, 471, 157 R, 43

[56] References Cited

U.S. PATENT DOCUMENTS

| | | | |
|---|---|---|---|
| 782,103 | 2/1905 | Bruner . | |
| 2,092,811 | 9/1937 | Moncrieff et al. . | |
| 2,345,538 | 3/1944 | Lewis . | |
| 2,345,544 | 3/1944 | Worthington . | |
| 2,352,780 | 7/1944 | Fletcher . | |
| 2,869,797 | 1/1959 | Clerc . | |
| 2,945,636 | 7/1960 | Lenk . | |
| 3,094,292 | 6/1963 | Hebberling . | |
| 3,169,717 | 2/1965 | Fox et al. . | |
| 3,227,192 | 1/1966 | Griffiths . | |
| 3,265,516 | 8/1966 | Triplett et al. . | |
| 3,279,904 | 10/1966 | Russell et al. | 242/18 G |
| 3,281,224 | 10/1966 | Lowe, Jr. | 242/18 G X |
| 3,371,877 | 3/1968 | Klink et al. . | |
| 3,382,123 | 5/1968 | Alexander . | |
| 3,414,956 | 12/1968 | Genson | 242/18 G |
| 3,438,587 | 4/1969 | Jackson . | |
| 3,512,725 | 5/1970 | Smith et al. | 242/18 G |
| 3,545,192 | 12/1970 | Hickman . | |
| 3,547,361 | 12/1970 | Klink . | |
| 3,552,667 | 1/1971 | Smith | 242/43 |
| 3,587,989 | 6/1971 | Fisher | 242/43 R X |
| 3,685,764 | 8/1972 | Drummond . | |

(List continued on next page.)

FOREIGN PATENT DOCUMENTS

| | | | |
|---|---|---|---|
| 496055 | 11/1950 | Belgium . | |
| 1229328 | 11/1987 | Canada . | |
| 0424701A1 | 2/1991 | European Pat. Off. . | |
| 0434129A2 | 6/1991 | European Pat. Off. . | |
| 45-7019 | 10/1970 | Japan . | |
| 162279 | 9/1964 | U.S.S.R. . | |
| 771543 | 4/1957 | United Kingdom | 242/43 |
| WO94/01604 | 1/1994 | WIPO . | |

OTHER PUBLICATIONS

"The Manufacturing Technology of Continuous Glass Fibres", K. L. Loewestein Glass Science and Technology 6, pp. 29, 30, 33–39, 169–179, 188–190, 201–207 and 243–295.

*Primary Examiner*—Michael R. Mansen
*Attorney, Agent, or Firm*—Ann Marie Odorski

[57] ABSTRACT

The present invention relates to methods and apparatus for winding a plurality of strands into a multilayered package. The preferred method includes: (a) supplying a plurality of strands; (b) aligning each of the strands in generally adjacent and coplanar alignment; (c) oscillating the strands about a pivot axis while maintaining the strands in alignment; (d) reciprocating a reciprocating device generally parallel to a central axis of rotation of a rotatable packaging collector; and (e) winding the strands about an arcuate surface of the collector to form a multilayered package, such that within each layer of strands wound upon the surface of the rotatable packaging collector, each of the plurality of strands is adjacent to each other and essentially free of overlap. The preferred apparatus includes a strand supply device; an alignment device; a strand oscillating device including a strand guide adapted to oscillate about a pivot axis and having a first arm and a second arm spaced apart to receive and align the strands; a winding device including a rotatable packaging collector having an arcuate surface adapted to receive the strands to form a multilayered package; and a reciprocating device, such that within each layer of strands wound upon the surface of the rotatable packaging collector, each of the plurality of strands is adjacent to each other and essentially free of overlap.

27 Claims, 6 Drawing Sheets

U.S. PATENT DOCUMENTS

| | | | |
|---|---|---|---|
| 3,758,013 | 9/1973 | Johnson . | |
| 3,823,884 | 7/1974 | Sartori | 242/43 X |
| 3,850,294 | 11/1974 | Philipps et al. . | |
| 3,901,455 | 8/1975 | Carlisle . | |
| 3,946,957 | 3/1976 | Van Gunten et al. | 242/43 R |
| 3,998,326 | 12/1976 | McKee, Jr. . | |
| 4,007,885 | 2/1977 | Hare et al. | 242/43 R |
| 4,046,330 | 9/1977 | Mueller . | |
| 4,130,248 | 12/1978 | Hendrix et al. . | |
| 4,167,252 | 9/1979 | Klink et al. . | |
| 4,239,162 | 12/1980 | Barch et al. . | |
| 4,322,041 | 3/1982 | Schuller et al. . | |
| 4,383,653 | 3/1983 | Nakazawa et al. . | |
| 4,403,744 | 9/1983 | Reese et al. . | |
| 4,434,946 | 3/1984 | Lewin et al. . | |
| 4,488,686 | 12/1984 | Reese . | |
| 4,509,702 | 4/1985 | Reese . | |
| 4,518,126 | 4/1985 | Marshall . | |
| 4,538,773 | 9/1985 | McEathron . | |
| 4,585,181 | 4/1986 | Schippers et al. . | |
| 4,693,429 | 9/1987 | Billard et al. . | |
| 4,798,347 | 1/1989 | Schippers et al. . | |
| 4,830,647 | 5/1989 | Watabe . | |
| 4,928,896 | 5/1990 | Symon . | |
| 4,955,552 | 9/1990 | Menegatto . | |
| 4,991,783 | 2/1991 | Sugioka . | |
| 5,029,762 | 7/1991 | Behrens et al. . | |
| 5,029,765 | 7/1991 | Gastreich . | |
| 5,054,705 | 10/1991 | Smith . | |
| 5,082,193 | 1/1992 | Boni . | |
| 5,100,072 | 3/1992 | Behrens et al. . | |
| 5,242,128 | 9/1993 | Polnik et al. | 242/43 R X |

APPARATUS AND METHODS FOR WINDING A PLURALITY OF STRANDS

FIELD OF THE INVENTION

The present invention relates generally to the winding of a plurality of textile strands or yarns and, more particularly, to winding improvements which enhance the separation of multiple textile strands during unwinding of a wound package.

BACKGROUND OF THE INVENTION

In a conventional glass fiber forming process, continuous filament glass fibers are produced by drawing molten glass at a high rate of speed from tips of small orifices in a precious metal device or bushing. The fibers are gathered together to form one or more bundles or strands which are wound upon a rotatable collector, such as a forming or collecting tube mounted upon a rotating cylinder or collet of a winder.

To initiate the fiber forming process, an operator pulls the fibers from the bushing and groups them together to form one or more strands. To protect the glass fibers from interfilament abrasion, a sizing composition may be applied to the surface of the fibers during the forming process. Generally, the sizing composition is applied to the glass fibers subsequent to fiber forming and prior to gathering of the strands on the collecting tube.

After application of the sizing composition, each strand is passed over a gathering guide and wound around one end of the collet beyond the collecting tube. The collet and collecting tube are rotated and, when the proper drawing speed is attained, the strands are bundled together and moved onto a traverse, for example, a spiral wire traverse as shown in U.S. Pat. No. 4,239,162 and K. Loewenstein, *The Manufacturing Technology of Glass Fibers,* (2d Ed. 1983) at pages 188–190, which is hereby incorporated by reference.

A variety of traverse mechanisms including a pivotable traverse arm have been proposed for winding a single strand or thread onto a rotating collector. For example, U.S. Pat. No. 3,169,717 discloses a primary traverse mechanism for traversing a strand comprising an oscillating strand engaging member or bar. The bar may be U-shaped or curved.

When multiple strands are wound into a forming package, slight differences in tension between the strands and tension changes arising from changes in geometry resulting from the rotation and stroke of the traverse may cause some strands to adhere to and overlap each other, causing difficulty in unwinding and separation of the strands.

For traversing a plurality of strands, U.S. Pat. No. 3,438,587 discloses an apparatus and method for winding a curtain of filaments onto a rotating collector. The apparatus includes rotatable probes which traverse the package parallel to the rotational axis of the package. The probes are pivotally adjustable to alter the position of the probes relative to each other.

U.S. Pat. Nos. 4,488,686, 4,509,702 and 4,538,773 disclose a traversing guide for winding a plurality of strands. The guide traverses the package parallel to the rotational axis of the package. The traverse guide has angularly opposing sides that converge to meet and extensions protruding each side to subtend partially the point of convergence of the opposing sides.

In a typical winding operation, the strands are reciprocated by the traverse over a length of the tube to wind the strands in a predetermined pattern lengthwise along the rotating tube to form a forming package. Typically, at least one of the spiral traverse or the collet is also reciprocated in a direction parallel to the central rotational axis of the collet.

The forming package may be dried at room temperature or heated in a drying oven to remove excess moisture and cure any curable component of the size, if present. The strands may be unwound from the package and combined in parallel form to form one or more rovings or wound upon a bobbin for use as a yarn in weaving.

The problem of winding a plurality of strands into a package in such a manner as to facilitate removal of the strands, mitigate overlapping and adhesion between the strands, reduce catenary and friction and strand breakage in the forming process has not been adequately resolved in the art.

SUMMARY OF THE INVENTION

Briefly stated, one aspect of the present invention is an apparatus for winding a plurality of strands into a multilayered package. The apparatus comprises a strand supply device for supplying a plurality of strands to a winding device. An alignment device is spaced apart from the strand supply device for aligning each of the plurality of strands received from the strand supply device such that each of the strands is generally adjacent and coplanar to each other. A strand oscillating device is spaced apart from the alignment device, the strand oscillating device comprising a strand guide adapted to oscillate about a pivot axis. The strand guide has a first arm and a second arm spaced apart to receive and maintain the plurality of strands in generally adjacent and coplanar alignment between the first arm and the second arm. A winding device is spaced apart from the strand oscillating device, the winding device comprising a rotatable packaging collector having a generally arcuate surface adapted to receive the plurality of strands from the strand oscillating device to form a multilayered package. A reciprocating device which reciprocates in a first direction generally parallel to a central axis of rotation of the rotatable packaging collector and a second direction opposite to the first direction is also included in the apparatus. The reciprocating device is selected from at least one of the strand oscillating device or the rotatable packaging collector. This apparatus can be used to produce multilayered packages in which each of the plurality of strands is adjacent to each other and essentially free of overlap within each of the layers.

In an alternative embodiment of the present invention, the strand oscillating device comprises a supporting member and a strand guide. The supporting member is rotatable about an axis generally perpendicular to the central axis of rotation of the rotatable packaging collector. The strand guide is rotatably mounted upon the supporting member and has an axis of rotation generally parallel to the rotational axis of the supporting member. The strand guide has a first arm and a second arm spaced apart to receive and maintain the plurality of strands in generally adjacent and coplanar alignment between the arms. The first arm and the second arm are positioned at an angle to the rotational axis of the supporting member.

Yet another aspect of the present invention is a method for winding a plurality of strands into a multilayered package. The method comprises: supplying a plurality of strands to a winding device; aligning each of the plurality of strands such that each of the strands is generally adjacent and coplanar to each other; oscillating the plurality of strands about a pivot axis while maintaining the plurality of strands in generally adjacent and coplanar alignment; reciprocating a reciprocating device generally parallel to a central axis of rotation of a rotatable packaging collector, the reciprocating device being selected from at least one of the strand oscillating device or the rotatable packaging collector; and winding the plurality of strands about a generally arcuate surface of a rotatable packaging collector to form a multilayered package, such that within each layer of strands wound upon the surface of the rotatable packaging collector, each of the plurality of strands is adjacent to each other and essentially free of overlap.

In an alternative method of the present invention, the plurality of strands is oscillated by rotating a supporting member of a strand oscillating device about an axis generally perpendicular to a central axis of a rotatable packaging collector. The strand oscillating device includes a rotatable strand guide including a first arm and a second arm spaced apart to maintain the plurality of strands in generally adjacent and coplanar alignment. The strand guide is rotatable about an axis generally parallel to the rotational axis of the supporting member. Each arm is positioned at an angle to the rotational axis of the support member.

BRIEF DESCRIPTION OF THE DRAWINGS

For the purpose of illustrating the invention, there is shown in the drawings an embodiment which is presently preferred, it being understood, however, that the invention is not limited to the specific arrangements and instrumentalities disclosed. In the drawings.

DETAILED DESCRIPTION OF THE PREFERRED EMBODIMENT

The present invention has several advantages, including improving the unwinding or payout of a plurality of strands from a wound package, reducing differences in length and tension between the strands to reduce catenary or sag, improving the split efficiency of the winding process and reducing friction and strand breakage in the forming process.

The present invention is generally useful in the manufacture of textile strands, bundles, yarns, filaments, fibers or the like of natural, man-made or synthetic materials. As used herein, the term "strand" is hereby defined as comprising at least one substantially continuous fiber or filament.

The present invention will be discussed generally in the context of its use in the manufacture and processing of glass fibers. However, one of ordinary skill in the art would understand that the present invention is useful for enhancing the processing of any of the textile materials discussed above.

Figure 1:
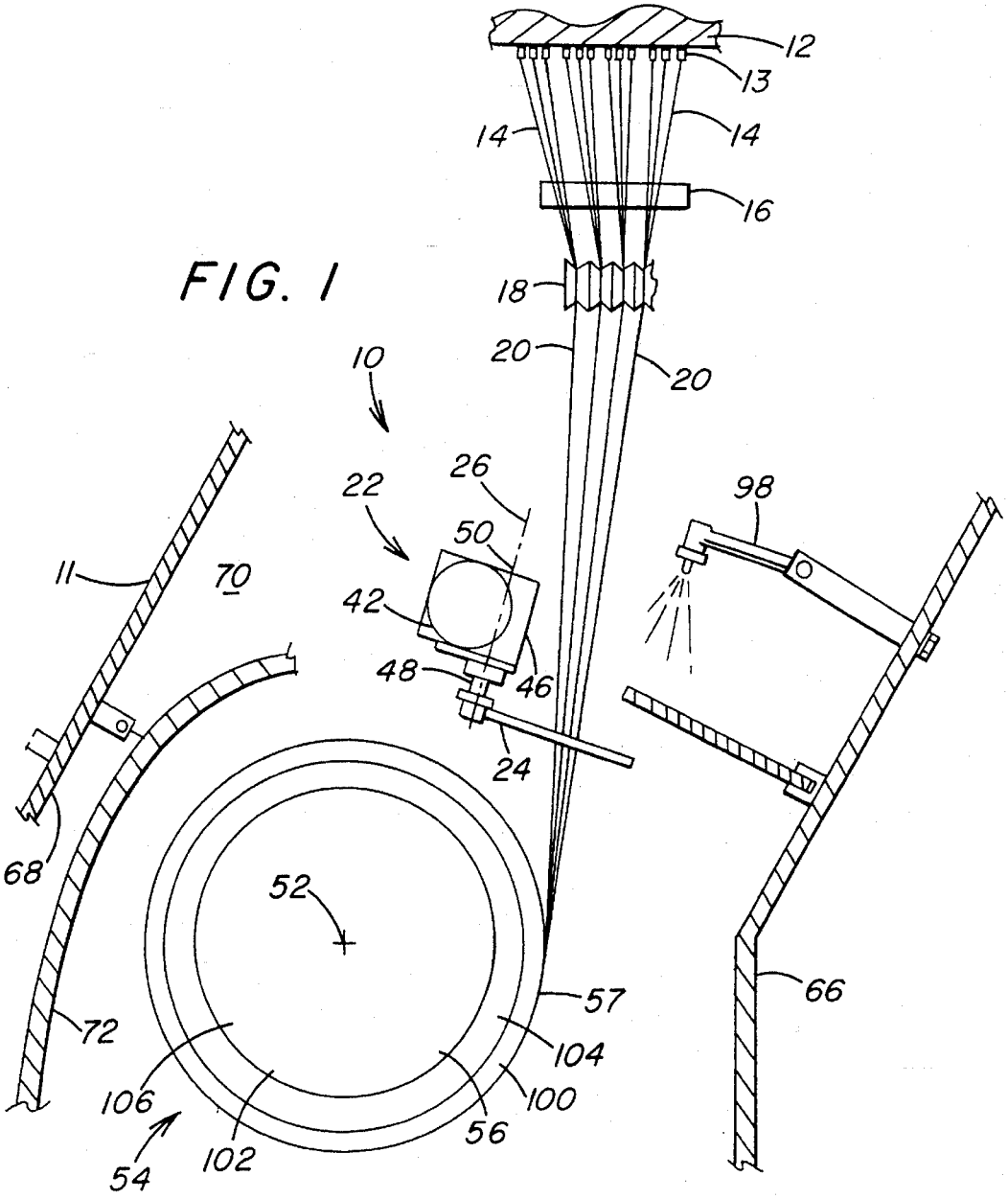
FIG. 1 is a schematic front elevational view of a portion of an apparatus for forming and winding a bundle of fibers according to the present invention.
Figure 2:
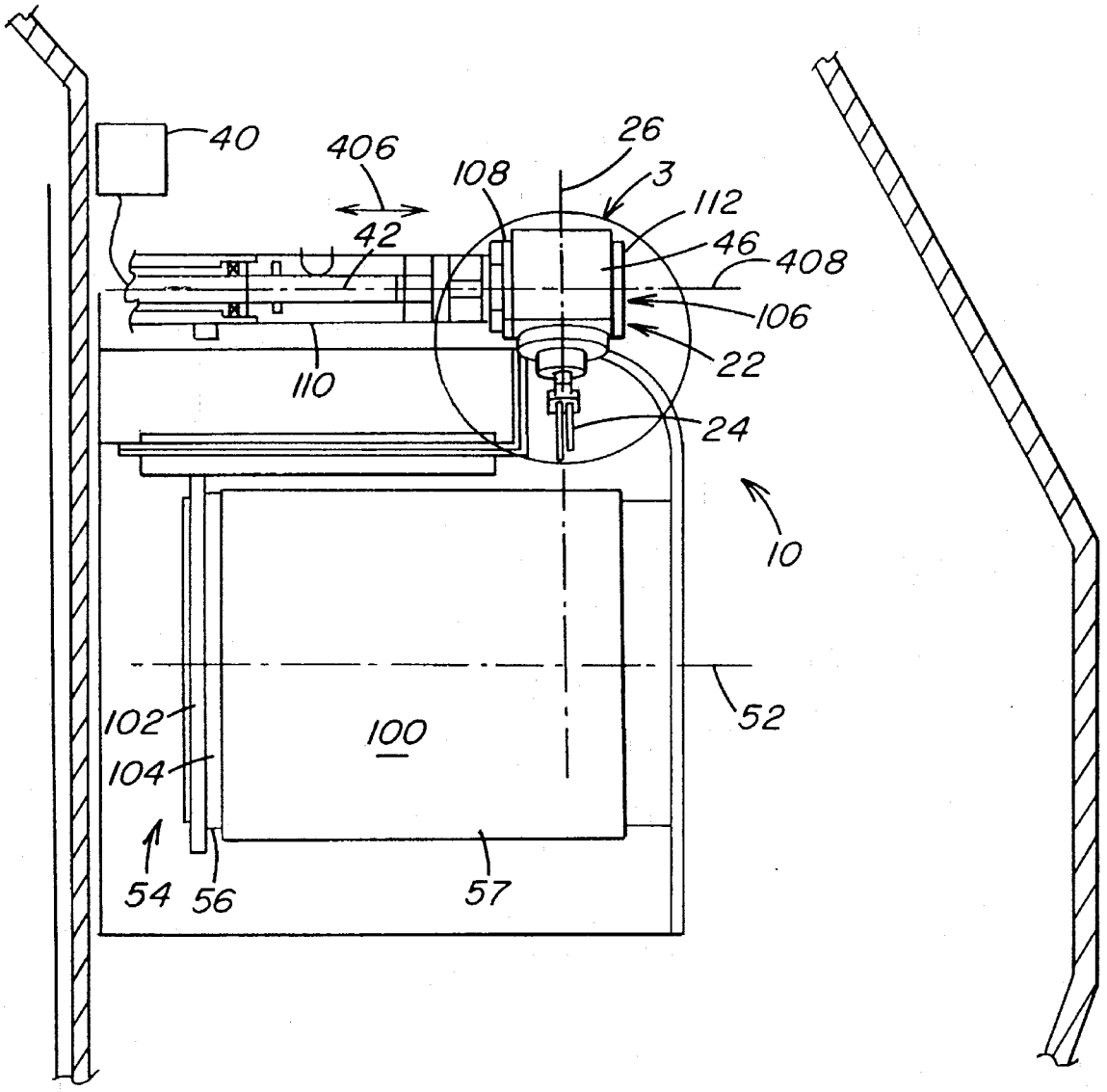
FIG. 2 is a top plan view of the apparatus of FIG. 1.

Referring now to the drawings, wherein like numerals indicate like elements throughout, there is shown in FIGS. 1 and 2 a portion of a preferred embodiment of a forming and winding apparatus, generally designated 10, in accordance with the present invention. As shown in FIG. 1, the apparatus 10 includes a strand supply device. As presently preferred, the strand supply device is a glass melting furnace or forehearth 12 containing a supply of a fiber forming mass or molten glass (not shown) having a precious metal bushing 13 attached to the bottom of the forehearth 12. Alternatively, the strand supply device can be, for example, a forming device for synthetic textile fibers or strands or packages of wound synthetic or natural textile fibers or strands.

As best shown in FIG. 1, the bushing 13 is provided with a series of orifices in the form of tips through which molten glass is drawn in the form of individual fibers 14 at a high rate of speed. Non-exclusive examples of suitable fiberizable glass compositions for use in the present invention include "E-glass", "621-glass", "A-glass", "C-glass", "S-glass" and lower free fluorine and/or boron derivatives thereof. One of ordinary skill in the art would understand that the apparatus and methods of the present invention would also be useful in processes involving winding of mono- or multifilament natural or synthetic materials or yarns such as nylon, polyester, boron or carbon fibers or strands.

The glass fibers 14 can be cooled by spraying with water and then coated with a chemical treating composition or coating comprising a moisture-containing size or binder by an applicator device 16 which contacts the fibers 14 prior to entering the gathering shoes 18. Suitable applicators are discussed in K. Loewenstein, *The Manufacturing Technology of Glass Fibers,* (2d Ed. 1983) at pages 169–177. One of ordinary skill in the art would understand that the applicator device can be a roller, pad, spray or any other applicator well known to those of ordinary skill in the art.

Typical sizing compositions include components such as film-formers, lubricants, coupling agents, emulsifiers, biocides and water, to name a few. Such components are well known to those of ordinary skill in the art. Non-limiting examples of suitable film-formers include starches, polyvinyl acetate and epoxy resins. Examples of typical lubricants are animal or vegetable oils. Suitable coupling agents include organo silane coupling agents.

As used herein, the phrase "sizing composition" or term "size" also refers to other film-forming and lubricant compositions which can be applied to the strands subsequent to formation of the forming package, for example during impregnating or slashing processes. Examples of suitable size compositions are set forth in U.S. Pat. Nos. 3,227,192 and 3,265,516, as well as European Patent Application No. 0424701 and in Loewenstein at pages 243–295, each of which are hereby incorporated by reference. These examples are merely provided for purposes of discussion and are not intended to limit the scope of the present invention. Generally, about 1 to about 10 weight percent of the size is solid material, with the remainder of the size being water.

As shown in FIG. 1, the strand supply device and applicator device 16 are preferably positioned above a frame 11 adapted to support an alignment device, a strand oscillating device 22, a winding device 54 and a reciprocating device of the apparatus 10. The frame 11 can include opposing first and second side walls 66, 68, a rear wall 70 connecting the first and second side walls 66, 68, and a splash guard 72 connected to at least the first and second side walls 66, 68 above the winding device 54.

The glass fibers 14 are gathered in an alignment device for aligning each of the plurality of strands such that each of the strands is generally adjacent and coplanar to each other. As used herein when referring to the alignment of the strands 20, the term "adjacent" means that the strands 20 are spaced apart or contacting in side-by-side or generally parallel alignment such that the strands 20 will generally be free of overlap when the strands 20 are wound in a layer about a rotatable collector.

The alignment device is generally spaced apart from the strand supply device to receive the plurality of strands from the supply device positioned above the alignment device. However, the alignment device can receive the plurality of strands from the supply source at any angle desired. Examples of suitable positions for the bushing 13 relative to the alignment device and winding device are provided in Loewenstein at pages 201–207, which are hereby incorporated by reference. The alignment device preferably aligns the strands generally perpendicularly to a central longitudinal axis 52 of the rotatable packaging collector 56.

Figure 1A:
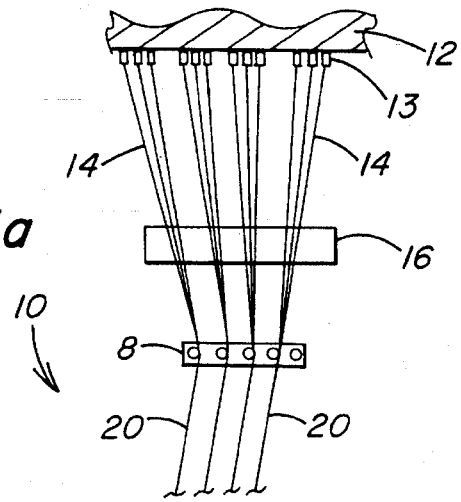
FIG. 1*a* is a schematic front elevational view of a portion of an alternative embodiment of an apparatus for forming and winding a bundle of fibers according to the present invention.

The alignment device can be any device(s) known to those skilled in the art for aligning strands or gathering filaments into strands such that each of the strands is generally parallel and coplanar. Non-limiting examples of suitable alignment devices include rotatable or stationary gathering shoes or a comb 8 (shown in FIG. 1*a*), as discussed in Loewenstein at pages 178–179, which are hereby incorporated by reference. The alignment device can be fabricated from any generally rigid natural or synthetic material, such as graphite, cotton and phenolic resin laminate, micarta or other reinforced phenolic laminates.

As shown in FIG. 1, the presently preferred alignment device comprises a plurality of graphite split stationary gathering shoes 18 which gather a plurality of fibers 14 to form a plurality of bundles or strands 20 and align the strands in a generally adjacent and coplanar arrangement. The gathering shoes 18 can be conventionally attached to at least one of the walls 66, 68, 70 of the frame 11.

While FIG. 1 shows four strands 20 being drawn from the forehearth 12, it is understood by those skilled in the art that the plurality of strands 20 can comprise two or more strands, as desired. Preferably, the plurality of strands comprises 3 to 20 strands and, more preferably, 3 to 16 strands.

The apparatus 10 can include a pull-down roller (not shown) to which the strands 20 are transferred to maintain pull of the fibers 14 from the bushing 13 when the strands 20 are not being wound about the winding device 54. Suitable pull-down rollers are discussed in Loewenstein at pages 179–181, which are hereby incorporated by reference.

As shown in FIGS. 1–4, the apparatus 10 further comprises a strand oscillating device, generally designated 22, spaced apart from and preferably positioned below the alignment device to receive the plurality of strands 20 from the alignment device and maintain the strands in generally adjacent and coplanar alignment.

Figure 3:
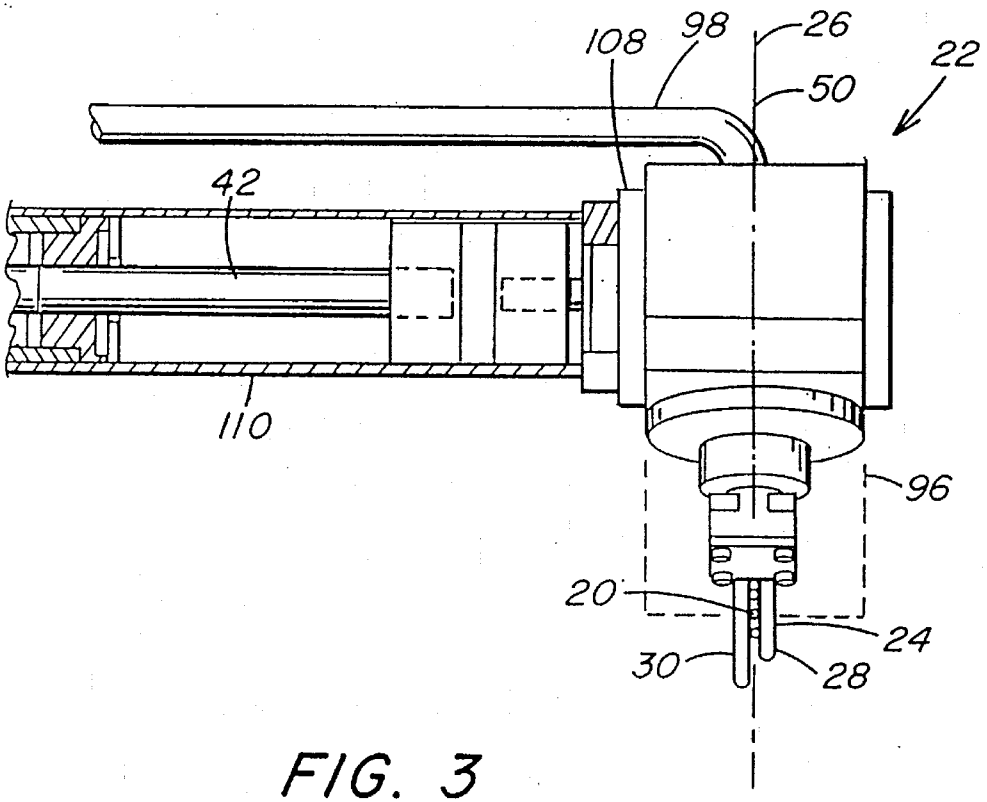
FIG. 3 is a top plan view of area 3 of FIG. 2 which further shows a housing for the strand oscillating device.

As shown in FIG. 2, the strand oscillating device 22 is preferably supported by and mounted upon a support member 108 by conventional mounting means well known to those of ordinary skill in the art. Referring now to FIG. 3, the support member 108 can be a generally cylindrical sleeve 110 and conventional mounting device 112 which houses a drive device for the strand oscillating device 22.

One of ordinary skill in the art would understand that the strand oscillating device 22 can alternatively be supported by the one of the side walls 66 or 68 so long as the strand oscillating device 22 is capable of oscillating the strands 20 while maintaining the strands in generally adjacent and coplanar alignment.

Figure 5:
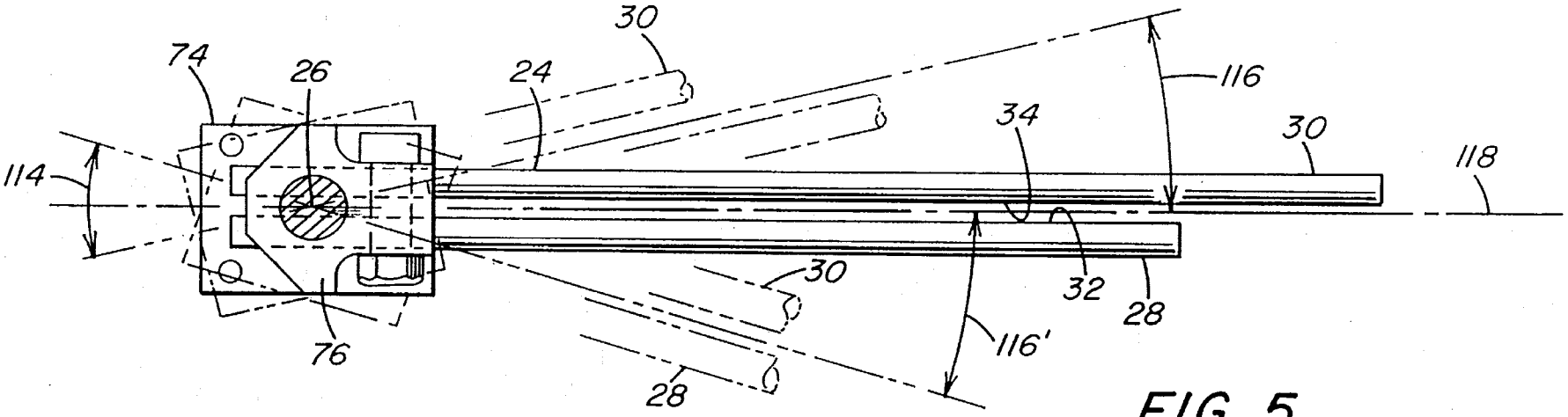
FIG. 5 is a top plan view of the strand guide of FIG. 1.

As presently preferred, the strand oscillating device 22 comprises a strand guide 24 adapted to oscillate about a pivot axis 26. As best shown in FIG. 5 in phantom, the arc or angle of oscillation, indicated at 114, of the strand guide 24 is preferably about 20 degrees to about 120 degrees, and more preferably about 20 degrees to about 50 degrees. In the presently preferred embodiment, the angle of oscillation is about 45 degrees. The angle of oscillation can be any suitable angle desired.

The determination of an appropriate angle of oscillation can be influenced by such variables as the number of strands and strand type, the length of the rotatable packaging collector 56 of the winding device 54, the winding pattern or split efficiency desired, the winder speed and the unwinding process to be used, to name a few.

The angle of displacement, indicated at 116, 116' in phantom in FIG. 5, of the strand guide 24 from a position (indicated by longitudinal axis 118) generally perpendicular to the central axis of rotation 52 of the rotatable collector 56 can be about −60 degrees to about +60 degrees. Preferably, the angle of displacement is about −25 degrees to about +25 degrees, and more preferably about −22.5 degrees to about +22.5 degrees (for a total angle of oscillation of about 45 degrees). The angle of displacement 116 can be greater than, less than or equal to the angle of displacement 116', as desired, to adjust the split efficiency. Preferably, the angles of displacement 116, 116' are equal.

The angular velocity at which the strand guide is oscillated depends upon such factors as the configuration and length of the arms 28, 30 of the strand guide 24, the weight and number of strands 20, the sizing composition, the winding speed, the unwinding or pay-out process to be used, the desired length and diameter of the forming package and package build, to name a few. The presently preferred angular velocity is about 300 to about 3000 arcs per minute, and more preferably about 1000 to about 2500 arcs per minute.

Figure 6:
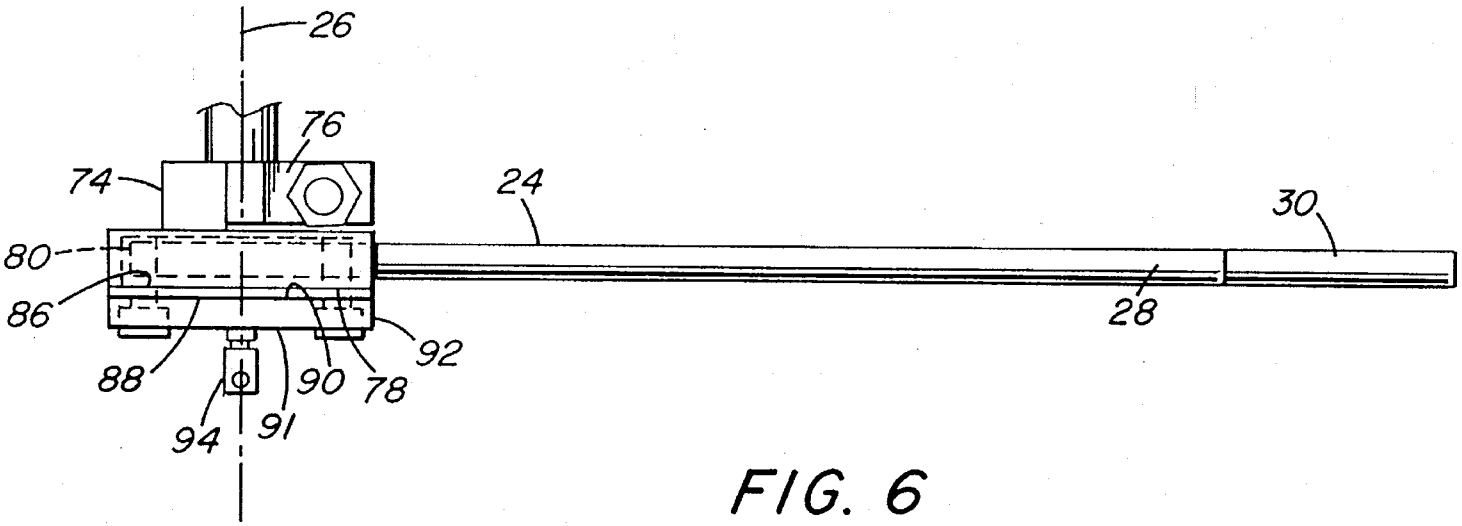
FIG. 6 is a side elevational view of the strand guide of FIG. 5.

As best shown in FIGS. 5 and 6, the strand guide 24 includes at least a first arm 28 and a second arm 30 spaced apart to receive and maintain the plurality of strands 20 in generally parallel and coplanar alignment between the arms 28, 30. The first arm 28 and second arm 30 are preferably generally parallel to each other and have smooth outer surfaces 32, 34, respectively, to facilitate alignment of the strands during winding and to minimize any abrasive effect by the arms 28, 30 upon the strands 20 which can cause strand breakage and deterioration in the overall quality of the strands. One of ordinary skill in the art, however, would understand that the first and second arms 28, 30 need not be parallel and can have indentations or protuberances, for example, in the outer surfaces 32, 34 thereof or can be tapered so long as the plurality of strands 20 is maintained in generally parallel and coplanar alignment between the arms 28, 30. Alternatively or additionally, the arms 28, 30 can be tapered or notched at the ends distal to the portion of the arms 28, 30 which contacts the strands 20 to secure the arms 28, 30 by centrifugal force in a clamp device.

As shown in FIG. 5, the first arm 28 and second arm 30 are spaced apart such that the distance between the outer surface 32 of the first arm 28 and the outer surface 34 of the second arm 30 is greater than or equal to the average diameter of the widest strand of the plurality of strands 20. For example, for five typical strands having 20 fibers per strand, the minimum distance between the outer surface 32 of the first arm 28 and the outer surface 34 of the second arm 30 is about 0.1 mm. As presently preferred, the distance between the opposing outer surface 32 of the first arm 28 and the outer surface 34 of the second arm 30 is about 0.1 mm to about 40 mm and, more preferably, about 4 mm to about 10 mm. This distance depends in part upon the pay-out or unwinding characteristics and angular configuration desired. Since the strands are maintained under tension due to the pulling force of the winder, each strand 20 tends to follow a linear line between the gathering shoe 18 and the rotatable collector 56.

Preferably, the length of the first arm 28 is less than the length of the second arm 30 to facilitate insertion of the strands 20 between the arms 28, 30. The length of each arm 28, 30 should be sufficient to retain each of the strands in generally parallel and coplanar alignment throughout the entire arc of the strand guide 24 during winding. For example, in the presently preferred embodiment in which six strands of about 1 mm average diameter are wound, the length of the first arm 28 can be about 20 mm to about 600 mm, and more preferably about 100 mm to about 200 mm. The length of the second arm 30 can be about 20 to about 600 mm, and more preferably about 100 mm to about 200 mm. Suitable lengths for the first arm 28 and the second arm 30 can be determined by assessing such variables as the number of strands to be wound, the average diameter of each of the strands and the arc and speed of travel of the strand guide, to name a few. Preferably the lengths of the arms 28, 30 differ by up to about 15 mm to facilitate insertion of the strands 20 during start-up of the winding process.

Figure 13:
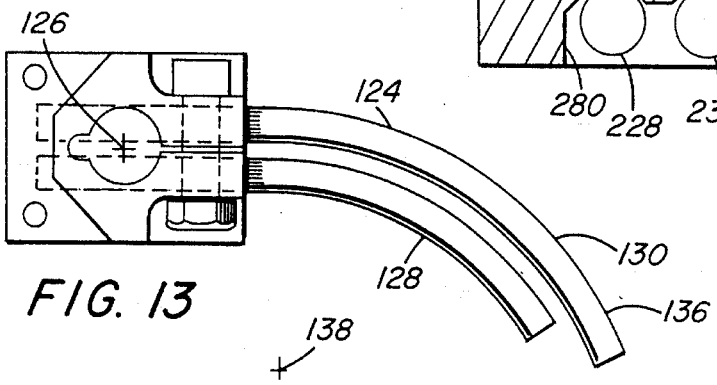
FIG. 13 is a top plan view of another alternative embodiment of the strand guide.

The first arm 28 and second arm 30 of the strand guide 24 are preferably generally linear tubes, as shown in FIGS. 5 and 6, or rods. In an alternative embodiment shown in FIG. 13, the arms 128, 130 can include a portion 136 which is angled or curved in an arc about an axis 138 generally parallel to the pivot axis 126.

Figure 11:
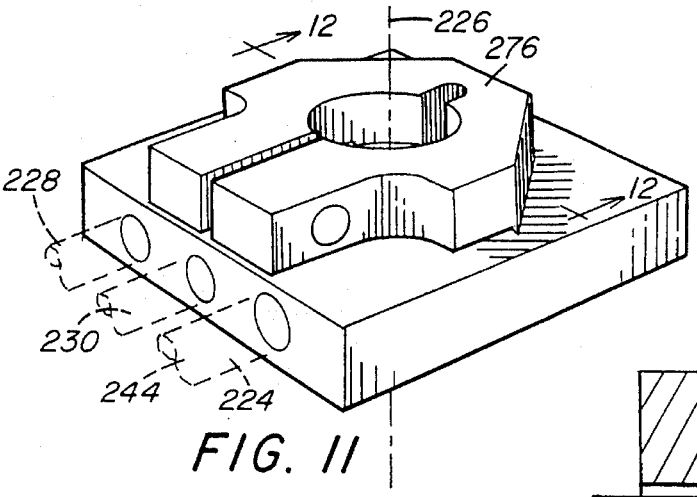
FIG. 11 is an isometric view of an alternative embodiment of a portion of the strand guide.
Figure 12:
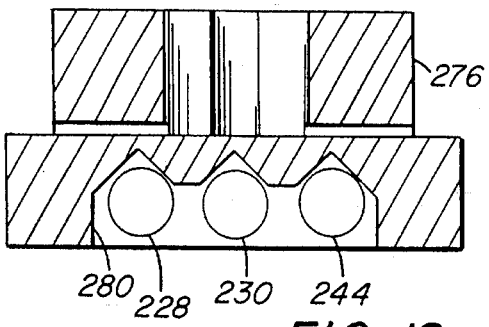
FIG. 12 is a cross-sectional side elevational view of the upper portion of the clamp device of FIG. 11, taken along lines 12—12 of FIG. 11.

The strand guide 24 can include at least one additional arm spaced apart from the first arm and the second arm to receive and maintain at least one of the plurality of strands in generally parallel and coplanar alignment therebetween. For example, in another alternative embodiment shown in FIGS. 11 and 12, the strand guide 224 includes a first arm 228, a second arm 230 and a third arm 244. The additional arm(s) are preferably similar to the first arm and second arm, although the configuration of the additional arms can vary as discussed above. The number of additional arms can be one or as many as are practically feasible, as desired.

The arms 28, 30 can be formed from any rigid or reinforced natural or synthetic material which is resistant to abrasive wear, such as for example aluminum, copper, brass, bronze, or a thermoplastic or thermoset material. Non-limiting examples of suitable reinforcements include rigid natural or synthetic material, such as graphite, glass or aramide. In the presently preferred embodiment, the arms 28, 30 are carbon-reinforced epoxy tubes.

The rods can have an outer diameter of about 1 to about 20 mm, or more preferably about 4 to about 8 mm. Suitable tubes can have an inner diameter of less than about 1 mm to about 10 mm, and more preferably about 4 mm to about 8 mm, and an outer diameter of about 1 mm to about 20 mm, and more preferably about 6 mm to about 8 mm.

Figure 14:
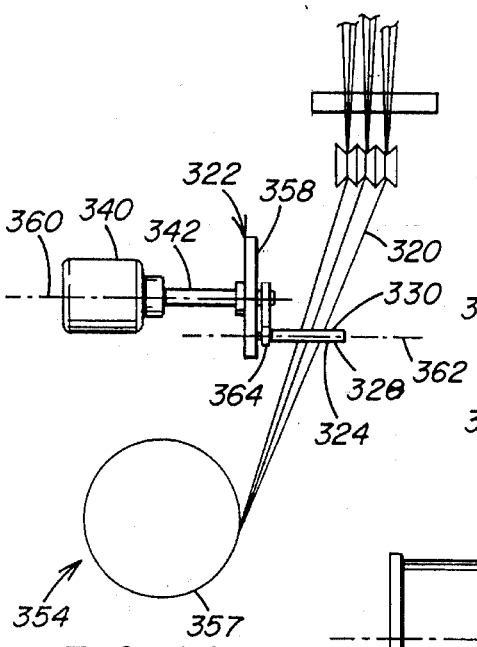
FIG. 14 is a front elevational view of yet another alternative embodiment of the strand guide.
Figure 15:
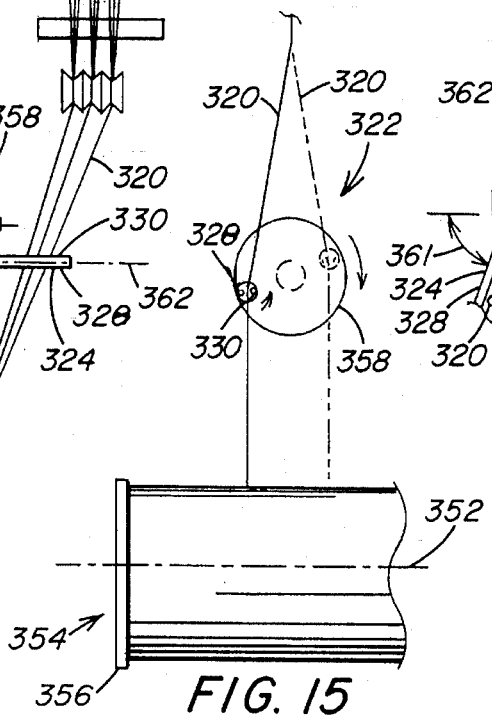
FIG. 15 is a partial side elevational view of the strand guide of FIG. 14.
Figure 16:
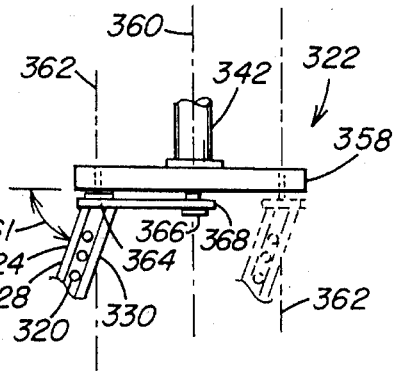
FIG. 16 is a partial top plan view of the strand guide of FIG. 14.

In an alternative embodiment shown in FIGS. 14–16, the strand oscillating device 322 comprises a supporting member 358 and a strand guide 324. The supporting member 358 is rotated or oscillated about an axis 360 generally perpendicular to a central axis of rotation 352 of the rotatable packaging collector 356 of the winding device 354. The supporting member 358 can be rotated up to a full 360 degree circle or less, as desired. Preferably, the supporting member 358 is a rigid circular plate or disc, which can be split, although the supporting member 358 can be of any shape suitable for supporting and translating rotational movement to the strand guide 324. The supporting member 358 is preferably made from a rigid natural or synthetic material such as stainless steel or aluminum, for example.

The strand guide 324 is rotatably mounted upon the supporting member 358 and has an axis of rotation 362 generally parallel to the rotational axis 360 of the supporting member 358 and generally perpendicular to the central axis of rotation 52 of the rotatable collector 56. Like the previous embodiments discussed above, the strand guide 324 has a first arm 328 and a second arm 330 spaced apart to receive and maintain the plurality of strands 320 in generally parallel and coplanar alignment therebetween. However, the first arm 328 and the second arm 330 are positioned at an angle to the rotational axis 360 of the supporting member 358.

The angle 361 shown in FIG. 16 at which the first arm 328 and the second arm 330 are positioned with respect to the rotational axis 360 of the supporting member 358 can be zero to about 60 degrees, and more preferably less than about 15 degrees. To permit the strand guide 324 to rotate freely about its axis of rotation 362 in response to the orientation of the plurality of strands, the strand guide 324 can be connected to the supporting member 358 by a cog wheels 364, 366 linked by a belt 368 to transmit rotational force from the supporting member 358 to the strand guide 324. Another example of a suitable coupling is a swivelable coupling which permits the strand guide to rotate independently of the rotation of the member 358 in response to the forces exerted by the strands, for example. One of ordinary skill in the art can readily determine a suitable coupling for connecting the strand guide 324 to the supporting member 358.

The strand oscillating device 22 further comprises a drive device for oscillating the strand guide 24 or, in the alternative embodiment of FIGS. 14–16, for rotating the strand guide 324. One of ordinary skill in the art would understand that any drive device which oscillates the strand guide 24 of the preferred embodiment of the present invention in a generally arcuate motion can be used in the present invention. For the alternative embodiment of the strand guide 324 shown in FIGS. 14–16, any drive device which rotates the supporting member 358 in a generally circular motion can be used in the present invention.

The preferred drive device shown in FIGS. 1–4 comprises a motor 40 for rotating a first drive shaft 42. The motor can be a conventional, preferably adjustable speed motor, such as a variable speed direct current (DC) motor or an alternating current (AC) motor including a power supply converter to permit adjustment of the motor speed. The preferred motor and converter are a 250 W AC motor, such as is commercially available from Heemaf, and a suitable converter such as are available from Borg-Warner.

The drive device for the preferred embodiment can also include a transmission 46 connected to the first drive shaft 42 for translating the rotational movement of the first drive shaft 42 to oscillate a second drive shaft 48 positioned generally perpendicularly to the first drive shaft 42. The second drive shaft 48 is oscillated about a longitudinal axis 50 (which is the same as the pivot axis 26 of the strand guide 24) generally perpendicular to an axis 52 of rotation of the rotatable packaging collector 56.

The transmission 46 preferably includes a groove roll (not shown) connected to the first drive shaft 42 and a mating ball bearing (not shown) connected to the second drive shaft 48 for translating the rotational movement of the first drive shaft 42 into the oscillating movement of the second drive shaft 48. Alternatively, a right angle gearbox or right angle oscillating drive can be used as the transmission 46. Any suitable transmission for translating the rotational movement of the first drive shaft 42 to oscillate a second drive shaft 48 positioned generally perpendicularly to the first drive shaft 42 can be used in the present invention.

The strand guide 24 can be connected to the second drive shaft 48 for pivotal movement about the longitudinal axis 50, i.e., pivot axis 26, of the second drive shaft 48. Any suitable connection means well known to those of ordinary skill in the art can be used to secure the strand guide 24 to the second drive shaft 48. In the preferred embodiment, the strand guide 24 is connected to the second drive shaft 48 by a clamp device 74 best shown in FIGS. 7–10.

Figure 7:
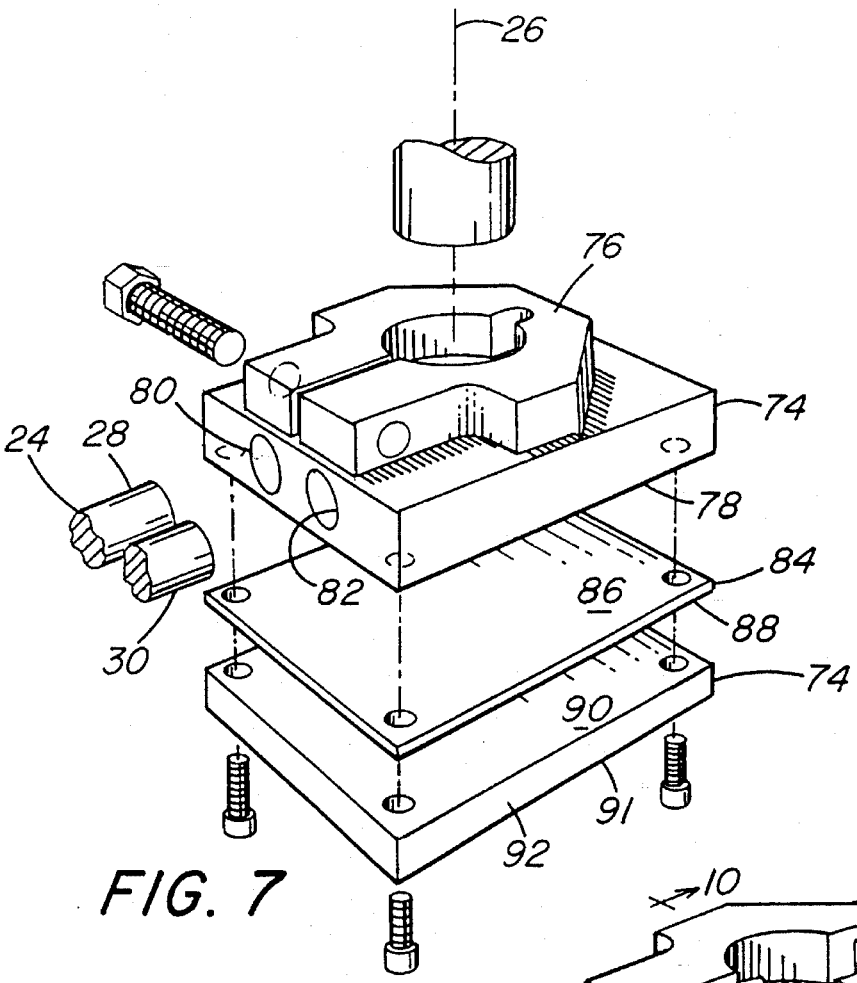
FIG. 7 is an exploded side elevational view of the clamp device portion of the strand guide of FIG. 5.
Figure 8:
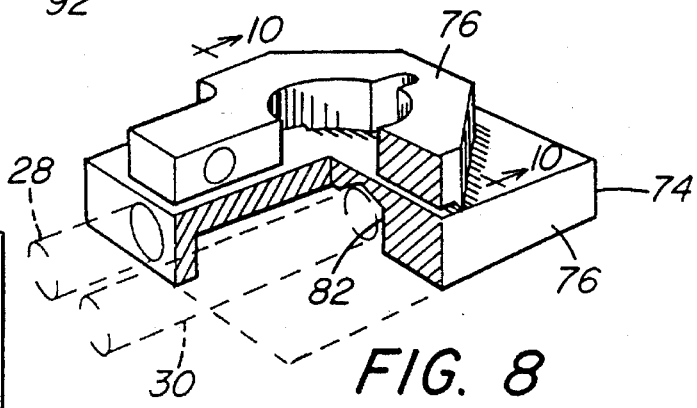
FIG. 8 is an isometric view showing an upper portion of the clamp device of FIG. 5.
Figure 9:
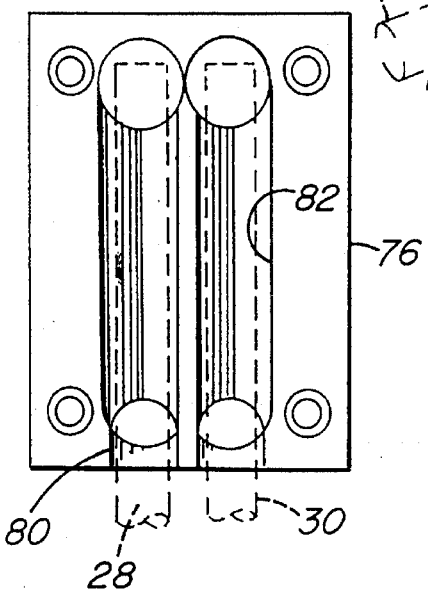
FIG. 9 is a top view showing positioning of the first and second arms within grooves of the rigid plate of the strand guide of FIG. 5.
Figure 10:
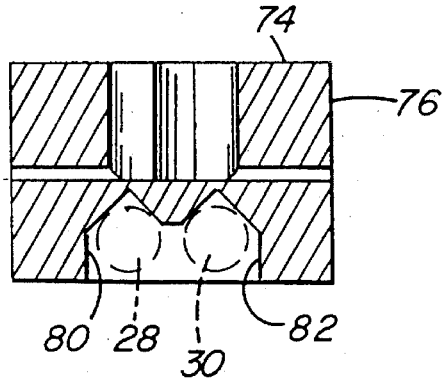
FIG. 10 is a cross-sectional side elevational view of the upper portion of the clamp device of FIG. 8, taken along lines 10—10 of FIG. 8.

Referring now to FIG. 7, the clamp device 74 comprises a retainer member 76 including a first side 78 having a first groove or slot 80 for retaining the first arm 28 of the strand guide 24 and a second slot 82 for retaining the second arm 30 of the strand guide 24. The retainer member can be formed from any rigid material, such as aluminum, which resists deformation due to stress forces transferred by contact of the strand guide 24 with the strands 20 and deterioration in the working environment by exposure to water and the sizing composition coating the strands.

The clamp device 74 also comprises a compressible plate or member 84 having a first side 86 contacting the first side 78 of the retainer member 76 and a second side 88 opposite the first side 86. The compressible plate 84 can be formed from any suitable compressible material, such as rubber or silicon rubber having a copper foil backing adjacent the rigid plate 92 to provide some structural integrity.

The second side 88 of the compressible plate 84 is contacted by a first side 90 of a substantially rigid plate or member 92. The substantially rigid plate 92 can be formed from any rigid material and is preferably formed from the same material as the retainer member 76.

Pressure is applied to the substantially rigid plate 92 to compress the compressible plate 84 against the retainer member 76 to retain and secure the first arm 28 of the strand guide 24 in the first slot 80 and the second arm 30 in the second slot 82 of the retainer member 76.

Figure 4:
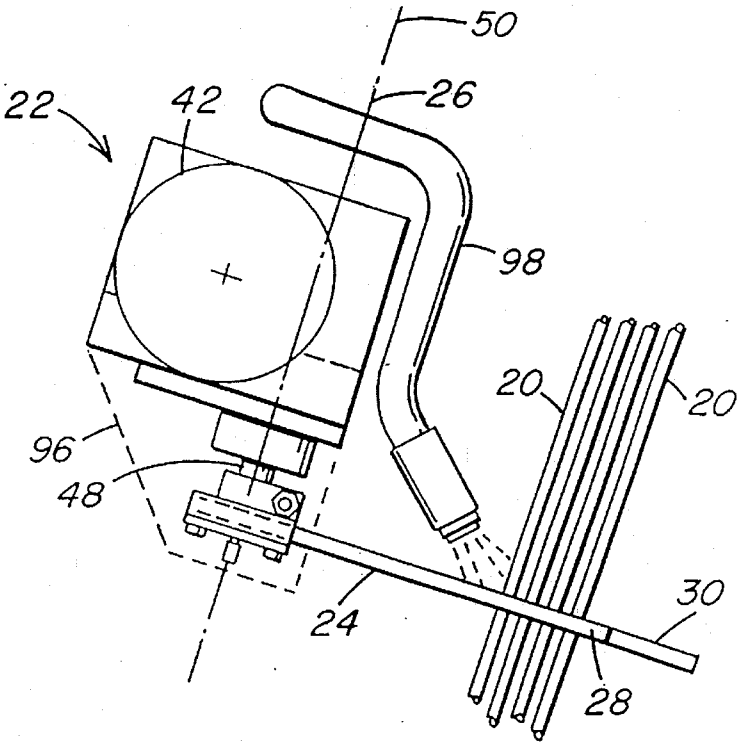
FIG. 4 is a side elevational view of the apparatus of FIG. 3.

As shown in FIGS. 4 and 6, the clamp device 74 includes a conventional pressure applicator 94 which applies pressure normal to a second side 91 of the substantially rigid plate 92 and second side 88 of the compressible plate 84 to retain the arms 28, 30 in the slots 80, 82, respectively. The pressure to be applied can be up to about 10 bars or more as needed to retain the arms 28, 30 in the slots 80, 82. Pressurized air is supplied to the pressure applicator 94 by an air supply hose (not shown). Alternatively, a clamp having conical arms can by used to apply pressure to the plates 92, 84.

As shown in FIGS. 3 and 4, the strand oscillating device 22 preferably includes a housing 96 for protecting the strand oscillating device 22 from water, sizing composition and other environmental conditions which can jam or deteriorate the working mechanism. The housing 96 was omitted only for purposes of clarity of the drawings in FIGS. 1–2.

As shown in FIGS. 1, 3 and 4, the apparatus 10 can further comprise a spray applicator 98 connected to the first side wall 66 for spraying a fluid, such as water, to lessen or remove sizing or fuzz buildup on the arms 28, 30 of the strand guide 24. The spray applicator 98 can be any conventional spray mechanism well known to those of ordinary skill in the art oriented to spray upon the arms 28, 30 of the strand guide 24. An alternative position for mounting the spray applicator 98 is shown in FIG. 1.

The apparatus 10 also comprises a winding device 54. The winding device 54 includes a rotatable packaging collector 56 about which the plurality of strands 20 are wound to form a multilayered package 100. The rotatable packaging collector 56 is preferably a collet device 102 having a collecting tube 104 removably telescoped thereon. The strands 20 are wound about at least a portion of the circumference of the collecting tube 104. The winding device 54 can be any conventional winder for winding standard forming or roving packages, such as are discussed in Loewenstein at pages 182–186, 192–198 and 317–323.

A discussion of the general dimensions and rotational speed of a collet device 102 are set forth in Loewenstein at pages 182–186. The collet device 102 is rotated by a motor (not shown). The speed of the motor is varied to reduce the rotational speed of the collet device 102 as the size of the forming package 100 increases during package build. Preferably, the rotational speed of the collet device 102 is about 1000 to about 6000 revolutions per minute (rpm).

A substantially constant linear strand collection speed attenuates glass fibers 14 of essentially uniform diameter during formation of the forming package 100. The diameter of each glass fiber can be any of the common fiber or filament designations, such as D through U, having respective diameters as set forth in Loewenstein at page 30.

The strands 20 are wound in generally parallel and coplanar alignment in layers to form the forming package 100 upon the arcuate surface of the collecting tube 104. Generally, forming packages are about 6 to about 20 inches in diameter and have a length of about 2 to about 30 inches. Conventional forming package dimensions are set forth in U.S. Pat. Nos. 3,685,764 and 3,998,326, each of which is hereby incorporated by reference. The sides of the forming package 100 can be tapered as the package 100 is built.

The apparatus 10 also includes a reciprocating device 106 for reciprocating in a first direction generally parallel to a central axis of rotation 52 of the rotatable packaging collector 56 and a second direction opposite to the first direction for a distance generally at least about equal to the length of the forming package 100. In the preferred embodiment shown in FIGS. 1 and 2, the reciprocating device 106 is the collet device 102 itself, which is reciprocated along its central axis 52.

In an alternative embodiment shown by the arrow 406 in phantom in FIG. 2, the reciprocating device is the strand oscillating device 22 which reciprocates along the rotational axis 408 of the first drive shaft 42. One of ordinary skill in the art would understand that either or both of the strand oscillating device 22 or the collet device 102 can be reciprocated, as desired.

When the forming package 100 is completed, the collecting tube 104 having the forming package 100 thereon is removed from the collet device 102 and replaced with an empty tube to repeat the process. At least a portion of the strands 20 can be unwound from the forming package 100 and used in a conventional weaving process or as a reinforcement for thermoplastic or thermosetting materials, for example.

The method according to the present invention for winding a plurality of strands into a multilayered package will now be described generally.

With reference to FIG. 1, the method generally comprises an initial step of supplying a plurality of strands to a winding device 54. In the presently preferred embodiment, the strands 20 are formed from fibers produced from a fiber forming mass, such as glass. Alternatively, the plurality of strands 20 can be supplied from packages of strands, as discussed above.

The method can optionally comprise the step of applying a chemical treatment or sizing composition to the plurality of strands. The sizing composition can be applied, for example, by contacting at least a portion of the fibers 14 with an applicator device 16 such that the sizing composition is deposited upon the surface of the fibers 20.

The method further comprises aligning each of the plurality of strands such that each of the strands is generally parallel and coplanar to each other. The strands 20 can be aligned by gathering groups of fibers 14 into individual strands 20 and passing the strands through gathering shoes 18 or other alignment devices.

The method further comprises a next step of oscillating the plurality of strands 20 about a pivot axis 26 while maintaining the plurality of strands 20 in generally parallel and coplanar alignment. The strands are preferably oscillated by alternately contacting each of the strands against a first arm 28 of the strand guide 24 to displace each of the strands in a first direction and against the second arm 30 of the strand guide 24 to displace each of the strands 20 in a second direction generally opposite the first direction while maintaining each of the strands in generally parallel and coplanar alignment.

In an alternative embodiment, the plurality of strands 320 is oscillated by rotating a supporting member 358 of a strand oscillating device 322 about an axis 360 generally parallel to the central axis 352 of the rotatable packaging collector 356. The strand oscillating device 322 includes a rotatable strand guide 324 including a first arm 328 and a second arm 330 spaced apart to maintain the plurality of strands 320 in generally parallel and coplanar alignment. Each arm 328, 330 is positioned at an angle 361 to the rotational axis 360 of the supporting member 358.

The method of the preferred embodiment also comprises the step of reciprocating a reciprocating device generally parallel to the central axis of rotation 52 of the rotatable packaging collector 56. The reciprocating device is selected from the strand oscillating device 22 and/or the rotatable packaging collector 56.

The method also comprises the step of winding the plurality of strands 20 about the rotatable packaging collector 56 to form a multilayered package 100. The plurality of strands 20 is wound about the rotatable packaging collector 56 in a plane generally parallel to the rotational axis 52 of the rotatable packaging collector 56, each of the strands being generally parallel to each other in the plane.

The method of the present invention is not limited to use in making forming packages, but can also be useful in any process in which a plurality of strands of material are wound into a multilayered package, such as a roving package.

The operation of the apparatus 10 to perform the method according to the present invention will now be described. However, other apparatus besides that shown and described herein could be used to perform the method of the present invention, if desired.

In the initial sequence of operation, the strands 20 are supplied to the winding device 54. In the preferred embodiment, glass fibers are formed and attenuated from a fiber forming mass. A sizing composition is applied to the glass fibers by contacting the fibers with an applicator device 16. The attenuated glass fibers are then grouped into a plurality of strands 20 and each strand is aligned in an alignment device or gathering shoe 18 such that each of the strands 20 is generally parallel and coplanar to each other.

Each of the plurality of strands is thread in side-by-side, parallel and coplanar arrangement between the first arm 28 and second arm 30 of the strand guide 24.

The winding device 54 is activated and the strands 20 are wound around the end of the collet device 102 or collecting tube 104 beyond the area upon which the forming package 100 is to be wound. The strands 20 are displaced to wind onto the collecting tube 104 as the reciprocating device is caused to reciprocate and the strand oscillating device 22 is activated to cause the strands 20 to be oscillated while maintaining the strands 20 in generally parallel and coplanar alignment.

The strands are wound in successive layers about the collecting tube 104 in generally parallel and coplanar alignment in a plane generally parallel to the rotational axis 52 of the rotatable packaging collector 56. When the winding of the forming package 100 is completed, the strands 20 are diverted to be wound about the area of the collet device 102 or collecting tube 104 beyond the area upon which the forming package 100 is wound. The strands can be then be diverted to the pull-down roll for subsequent winding about another forming package and the oscillation of the oscillator device and rotating of the collet device 102 are ceased to permit removal of the package 100.

From the foregoing description, it can be seen that the present invention comprises methods and apparatus for winding a plurality of strands into a multilayered package such that the plurality of strands are adjacent in generally side-by-side configuration in a layer and free of overlap. This configuration facilitates unwinding of the package and, among other advantages, reduces strand breakage and catenary and tension differences between the strands.

It will be appreciated by those skilled in the art that changes could be made to the embodiments described above without departing from the broad inventive concept thereof.

It is understood, therefore, that this invention is not limited to the particular embodiments disclosed, but it is intended to cover modifications which are within the spirit and scope of the invention, as defined by the appended claims.

Therefore, we claim:

1. An apparatus for winding a plurality of strands into a multilayered package, comprising:

(a) a strand supply device for supplying a plurality of strands to a winding device;

(b) an alignment device spaced apart from the strand supply device for aligning each of the plurality of strands received from the strand supply device such that each of the strands is generally adjacent and coplanar to each other;

(c) a strand oscillating device spaced apart from the alignment device, the strand oscillating device comprising a strand guide adapted to oscillate about a pivot axis which is generally perpendicular to a central axis of rotation of a rotatable packaging collector, the strand guide having a first arm and a second arm spaced apart to receive and maintain the plurality of strands in generally adjacent and coplanar alignment between the first arm and the second arm;

(d) a winding device spaced apart from the strand oscillating device, the winding device comprising a rotatable packaging collector having a generally arcuate surface adapted to receive the plurality of strands from the strand oscillating device to form a multilayered package; and (e) a reciprocating device for reciprocating the strand guide relative to the rotatable packaging collector in a first direction generally parallel to a central axis of rotation of the rotatable packaging collector and a second direction opposite to the first direction, the reciprocating device being selected from at least one of the strand oscillating device and the rotatable packaging collector, such that, within each layer of strands wound upon the surface of the rotatable packaging collector, each of the plurality of strands is adjacent to each other and essentially free of overlap and the strand guide oscillates about the pivot axis generally continuously during winding.

2. The apparatus according to claim 1, wherein the strand supply device comprises a fiber forming apparatus for forming the plurality of fibers from a fiber forming mass.

3. The apparatus according to claim 1, wherein the plurality of strands comprise glass fibers.

4. The apparatus according to claim 1, further comprising an applicator device for applying a chemical treating composition to the plurality of strands before the strands are aligned by the alignment device.

5. The apparatus according to claim 1, wherein the alignment device is selected from a gathering shoe and a comb.

6. The apparatus according to claim 1, wherein the alignment device aligns the strands generally perpendicularly to a longitudinal axis of the rotatable packaging collector.

7. The apparatus according to claim 1, wherein the alignment device is spaced apart from the strand supply device to receive the plurality of strands from above the alignment device.

8. The apparatus according to claim 1, wherein the plurality of strands includes 2 to 20 strands.

9. The apparatus according to claim 1, wherein the angle of oscillation of the strand guide is 20 degrees to 120 degrees.

10. The apparatus according to claim 1, wherein the strand oscillating device further comprises a motor for rotating a first drive shaft, a transmission connected to the drive shaft for translating the rotational movement of the first drive shaft to oscillate a second drive shaft about a longitudinal axis generally perpendicular to an axis of rotation of the rotatable packaging collector, the strand guide being connected to the second drive shaft and pivoting about the longitudinal axis of the second drive shaft.

11. The apparatus according to claim 10, wherein the strand oscillating device further comprises a clamp device for connecting the second drive shaft and the strand guide.

12. The apparatus according to claim 11, wherein the clamp device comprises a retainer member including a first side having a first slot for retaining the first arm of the strand guide and a second slot for retaining the second arm of the strand guide, a compressible plate contacting the first side of the retainer member, a substantially rigid plate contacting the compressible plate opposite the retainer member, and a pressure applicator for applying pressure to the substantially rigid plate, such that when the pressure applicator is pressurized, pressure is applied to the substantially rigid plate and the compressible plate to secure the first arm in the first slot and the second arm in the second slot.

13. The apparatus according to claim 1, wherein the first arm is spaced apart 0.1 mm to 40 mm from the second arm.

14. The apparatus according to claim 1, wherein a length of the first arm is less than a length of the second arm.

15. The apparatus according to claim 1, wherein at least one of the arms is selected from the group consisting of a tube and a rod.

16. The apparatus according to claim 1, wherein at least one of the arms is a carbon-reinforced epoxy tube.

17. The apparatus according to claim 1, wherein the first arm and the second arm of the strand guide each include at least a portion which is curved in an arc about an axis generally parallel to the pivot axis, the first arm and the second arm being spaced apart generally equidistant.

18. The apparatus according to claim 1, wherein the strand guide further comprises at least one additional arm spaced apart from the first arm and the second arm to receive and maintain at least one of the plurality of strands in generally adjacent and coplanar alignment therebetween.

19. The apparatus according to claim 1, further comprising a spray applicator for spraying a fluid onto the arms of the strand guide.

20. The apparatus according to claim 1, further comprising a frame adapted to support the alignment device, the strand oscillating device, the winding device and the reciprocating device, the strand supply device being positioned above the frame.

21. An apparatus for winding a plurality of strands into a multilayered package, comprising:

(a) a strand supply device for supplying a plurality of strands to a winding device;

(b) an alignment device spaced apart from the strand supply device for aligning each of the plurality of strands such that each of the strands is generally adjacent and coplanar to each other;

(c) a strand oscillating device spaced apart from the alignment device, the strand oscillating device comprising a supporting member and a strand guide, the supporting member being rotatable about an axis generally perpendicular to a central axis of rotation of a rotatable packaging collector, the strand guide being rotatably mounted upon the supporting member and having an axis of rotation generally parallel to the rotational axis of the supporting member, the strand guide having a first arm and a second arm spaced apart to receive and maintain the plurality of strands in generally adjacent and coplanar alignment therebetween, the first arm and the second arm being positioned at an angle to the rotational axis of the supporting member;

(d) a winding device spaced apart from the strand oscillating device, the winding device comprising a rotatable packaging collector having a generally arcuate surface adapted to receive the plurality of strands from the strand oscillating device to form a multilayered package; and (e) a reciprocating device for reciprocating the strand guide relative to the rotatable packaging collector in a first direction generally parallel to a central axis of rotation of the rotatable packaging collector and a second direction opposite to the first direction, the reciprocating device being selected from the group consisting of at least one of the strand oscillating device and the rotatable packaging collector, such that, within each layer of strands wound upon the surface of the rotatable packaging collector, each of the plurality of strands is adjacent to each other and essentially free of overlap and the strand guide oscillates about the pivot axis generally continuously during winding.

22. A method for winding a plurality of strands into a multilayered package, comprising:

(a) supplying a plurality of strands to a winding device;

(b) aligning each of the plurality of strands such that each of the strands is generally adjacent and coplanar to each other;

(c) generally continuously oscillating the plurality of strands with a strand oscillating device during winding about a pivot axis which is generally perpendicular to a central axis of rotation of a rotatable packaging collector while maintaining the plurality of strands in generally adjacent and coplanar alignment;

(d) reciprocating a reciprocating device in a first direction generally parallel to a central axis of rotation of a rotatable packaging collector and a second direction opposite the first direction, the reciprocating device being selected from at least one of the strand oscillating device and the rotatable packaging collector; and (e) winding the plurality of strands about a generally arcuate surface of a rotatable packaging collector to form a multilayered package, such that within each layer of strands wound upon the surface of the rotatable packaging collector, each of the plurality of strands is adjacent to each other and essentially free of overlap.

23. The method according to claim 22, further comprising forming the plurality of strands from a fiber forming mass.

24. The method according to claim 22, wherein the plurality of strands comprise glass fibers.

25. The method according to claim 22, further comprising applying a chemical treatment composition to the plurality of strands.

26. The method according to claim 22, wherein the step of oscillating the plurality of strands about the pivot axis comprises alternately contacting each of the strands against a first arm of a strand guide to displace each of the strands in a first direction and against a second arm of the strand guide to displace each of the strands in a second direction generally opposite the first direction while maintaining each of the strands in generally adjacent and coplanar alignment.

27. A method for winding a plurality of strands into a multilayered package, comprising:

(a) supplying a plurality of strands to a winding device;

(b) aligning each of the plurality of strands such that each of the strands is generally adjacent and coplanar to each other;

(c) generally continuously oscillating the plurality of strands during winding by rotating a supporting member of a strand oscillating device about an axis generally perpendicular to a central axis of a rotatable packaging collector, the strand oscillating device including a rotatable strand guide including a first arm and a second arm spaced apart to maintain the plurality of strands in generally adjacent and coplanar alignment, the strand guide being rotatable about an axis generally parallel to the rotational axis of the supporting member, each arm being positioned at an angle to the rotational axis of the supporting member;

(d) reciprocating a reciprocating device in a first direction generally parallel to a central axis of rotation of a rotatable packaging collector and a second direction opposite the first direction, the reciprocating device being selected from at least one of the strand oscillating device and the rotatable packaging collector; and (e) winding the plurality of strands about a generally arcuate surface of a rotatable packaging collector to form a multilayered package, such that within each layer of strands wound upon the surface of the rotatable packaging collector, each of the plurality of strands is adjacent to each other and essentially free of overlap.

* * * * *